US008819898B2

(12) United States Patent
Xie

(10) Patent No.: US 8,819,898 B2
(45) Date of Patent: Sep. 2, 2014

(54) HANDLE STRUCTURE

(71) Applicant: Jian-Min Xie, Changhua County (TW)

(72) Inventor: Jian-Min Xie, Changhua County (TW)

( * ) Notice: Subject to any disclaimer, the term of this patent is extended or adjusted under 35 U.S.C. 154(b) by 0 days.

(21) Appl. No.: 13/896,505

(22) Filed: May 17, 2013

(65) Prior Publication Data

US 2014/0082888 A1 Mar. 27, 2014

(30) Foreign Application Priority Data

Sep. 21, 2012 (TW) ..... 101218338 U

(51) Int. Cl.
*E05B 1/00* (2006.01)

(52) U.S. Cl.
CPC ..... *E05B 1/0015* (2013.01); *Y10S 16/30* (2013.01)
USPC ..... 16/414; 16/417; 16/441; 16/DIG. 30; 74/553

(58) Field of Classification Search
USPC ..... 16/110.1, 415–420, 433, 441, 412, 16/DIG. 30; 312/348.6; 74/553
See application file for complete search history.

(56) References Cited

U.S. PATENT DOCUMENTS

| | | | | | |
|---|---|---|---|---|---|
| 3,986,409 | A | * | 10/1976 | Tripp et al. | 74/548 |
| 4,300,525 | A | * | 11/1981 | Delgado et al. | 126/42 |
| 5,364,065 | A | * | 11/1994 | Tauati | 251/96 |
| 5,551,124 | A | * | 9/1996 | Zeringue | 16/441 |
| 5,671,904 | A | * | 9/1997 | Minutillo | 251/96 |
| 5,765,449 | A | * | 6/1998 | LeMire | 74/553 |
| 5,887,927 | A | * | 3/1999 | Kurek et al. | 294/158 |
| 6,842,946 | B2 | * | 1/2005 | Hayden | 16/414 |
| 7,908,713 | B2 | * | 3/2011 | Yoshinaka et al. | 16/441 |

* cited by examiner

*Primary Examiner* — William Miller
(74) *Attorney, Agent, or Firm* — Alan Kamrath; Kamrath IP Lawfirm, P.A.

(57) ABSTRACT

A handle structure contains a body, a housing, a cover, a controlling member, and a resilient element. The body includes an outer surface and an inner surface, the outer face has a non-grip face and a flat rim, and the inner surface has a connecting column. The housing is hollow and includes a front fringe, a rear fringe, and a L-shaped recess. The cover is fixed on a rear side of the housing and used to fix a handle structure on a plate. The controlling member is fitted into the housing and includes a front end and a rear end. The front end connects with the connecting column via the front fringe. The controlling member also includes a raised portion fixed in the L-shaped recess. The resilient element located between the controlling member and the cover. Hence, the controlling member is pushed by the resilient element to move toward the body.

15 Claims, 11 Drawing Sheets

HANDLE STRUCTURE

BACKGROUND OF THE INVENTION

1. Field of the Invention

The present invention relates to a handle structure and, more particularly, to a safe handle structure used on a cabinet door plate or a drawer front.

2. Description of the Prior Art

A conventional handle used for a cabinet or a drawer is flat or raised. The flat handle matches with a door plate or a drawer front with a recess, such that a user inserts fingers into the recess to hold the handle and then to pull the cabinet door or the drawer outwardly. Another raised handle is fixed on the door plate or the drawer front, so that the handle is held by the user to open the cabinet door or the drawer.

However, such two conventional handles allow children to open the cabinet door or the drawer easily and injure the children. Also, the flat handle cannot be operated safely, and the raised handle occupies operation space, interferes with people's activities, and hooks an object easily.

The present invention has arisen to mitigate and/or obviate the afore-described disadvantages.

SUMMARY OF THE INVENTION

The primary objective of the present invention is to provide a handle structure in which a body is contacted with or retained in a plate to prevent children from rotating a door or sliding a drawer.

A further objective of the present invention is to provide a handle structure in which a body is contacted with or retained in a plate to avoid interfering with people's activities or hooking an object.

Another objective of the present invention is to provide a handle structure in which a body is moved forward to be further opened easily.

To obtain the above objectives, a handle structure contains:

a body including an outer surface and an inner surface, with the outer face having a non-grip face and a flat rim defined between the non-grip face and the inner surface, with the inner surface having a connecting column;

a housing formed in a hollowly circular tube shape and including a front fringe, a rear fringe, and a L-shaped recess defined on an outer wall thereof;

a cover fixed on a rear side of the housing and used to fix a handle structure on a door plate or a drawer front;

a controlling member fitted into the housing and including a front end and a rear end, with the front end of the controlling member connecting with the connecting column of the body via the front fringe of the housing, with the controlling member also including a raised portion formed on a rear side thereof and fixed in the L-shaped recess of the housing; and a resilient element located between the controlling member and the cover, such that the controlling member is pushed by the resilient element to move toward the body.

In addition, another handle structure of the present invention contains:

a body being cylindrical and including a connecting column fixed on a rear side thereof;

a housing formed in a hollow circular tube shape and including a front fringe, a rear fringe, and a L-shaped recess defined on an outer wall thereof;

a cover fixed on a rear side of the housing and used to fix the body in a groove of a door plate or a drawer front, with the body being aligned with a slot of the door plate or the drawer front relative to the groove;

a controlling member fitted into the housing and including a front end and a rear end, with the front end of the controlling member connecting with the connecting column of the body via the front fringe of the housing, with the controlling member also including a raised portion formed on a rear side thereof and fixed in the L-shaped recess of the housing; and a resilient element located between the controlling member and the cover, such that the controlling member is pushed by the resilient element to move toward the body.

DETAILED DESCRIPTION OF THE PREFERRED EMBODIMENTS

Figure 1:
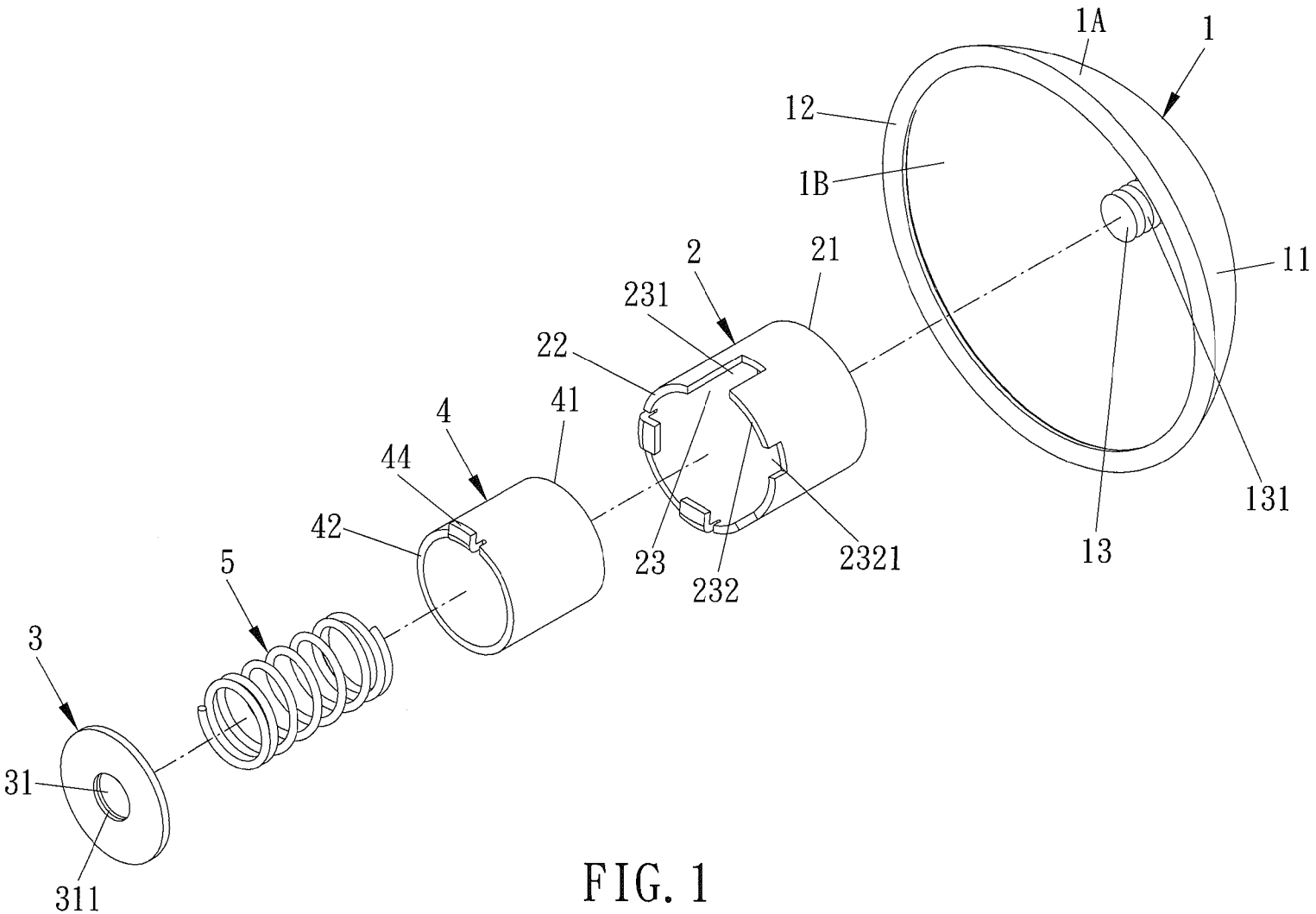
FIG. 1 is a perspective view showing the exploded components of a handle structure according to a first embodiment of the present invention.
Figure 2:
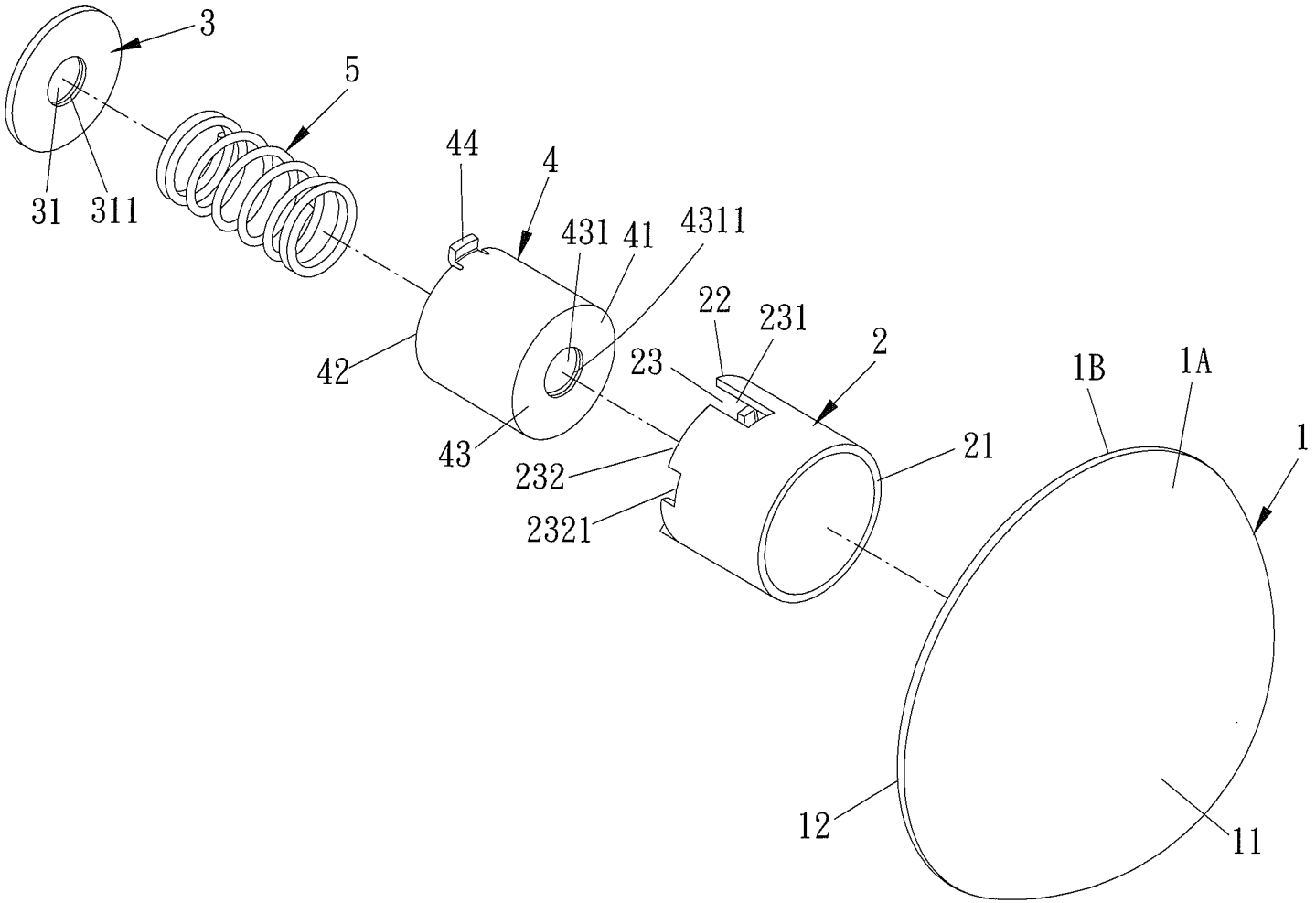
FIG. 2 is another perspective view showing the exploded components of a handle structure according to the first embodiment of the present invention.
Figure 3:
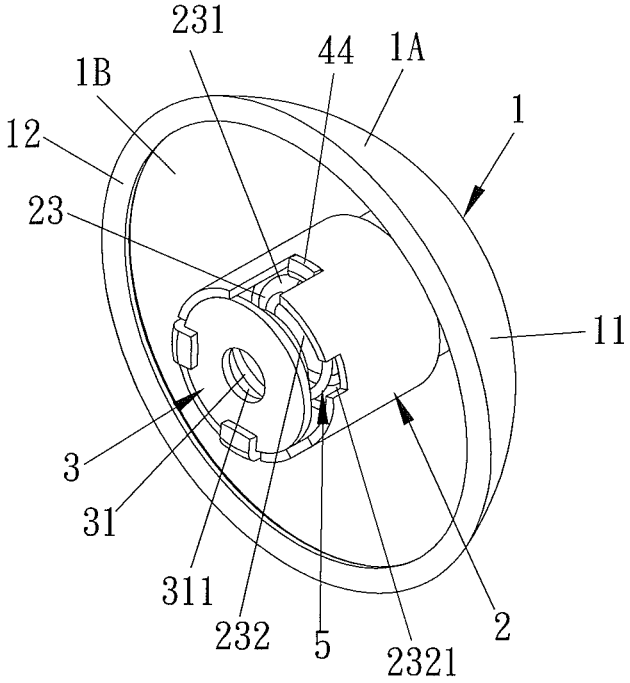
FIG. 3 is a perspective view showing the assembly of the handle structure according to the first embodiment of the present invention.
Figure 4:
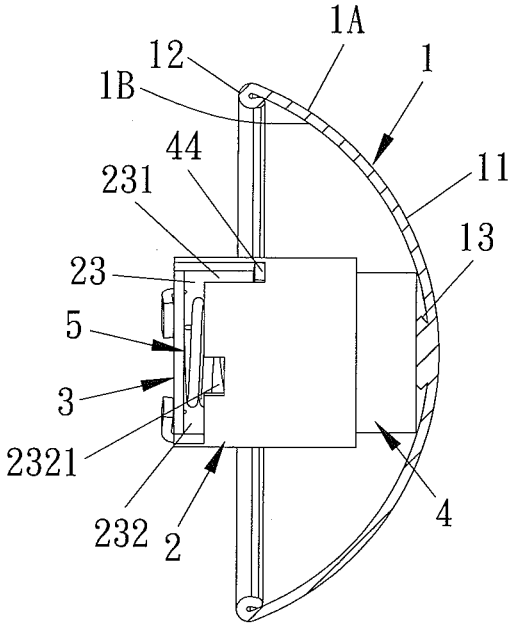
FIG. 4 is a cross sectional view showing the assembly of the handle structure according to the first embodiment of the present invention.

The present invention will be clearer from the following description when viewed together with the accompanying drawings, which show, for purpose of illustration only, the preferred embodiments in accordance with the present invention.

With reference to FIGS. 1-4, a handle structure according to a first embodiment of the present invention comprises: a body 1, a housing 2, a cover 3, a controlling member 4, and a resilient element 5. The body 1 includes an outer surface 1A and an inner surface 1B, and the outer surface 1A has a non-grip face 11 and a flat rim 12 defined between the non-grip face 11 and the inner surface 1B. The inner surface 1B has a connecting column 13 with outer threads 131, and the non-grip face 11 has an arcuate portion or patterns formed thereon. The housing 2 is formed in a hollow circular tube shape and includes a front fringe 21, a rear fringe 22, and a L-shaped recess 23 defined on an outer wall thereof. The L-shaped recess 23 has an axial section 231 and a radial section 232 adjacent to the axial section 231, and the radial section 232 has a cutout 2321 arranged thereon. The cover 3 is covered onto or integrally formed with a rear side of the housing 2 and includes a hole 31 with inner threads 311. The controlling member 4 is cylindrical and fitted into the housing 2. The controlling member 4 includes a front end 41 and a rear end 42, and the front end 41 of the controlling member 4 has a disc 43. The disc 43 has an orifice 431 defined thereon, and the orifice 431 has an inner threaded section 4311. Thus, the connecting column 13 of the body 1 screws with the inner threaded section 4311 of the orifice 431 via the front fringe 21. Hence, the body 1 connects with the controlling member 4. In addition, the controlling member 4 includes a raised portion 44 formed on a rear side thereof and fixed in the L-shaped recess 23 of the housing 2. The resilient element 5 is a spring mounted in the housing 2 and located between the controlling member 4 and the cover 3, such that the controlling member 4 is pushed by the resilient element 5 to move toward the body 1.

Figure 5:
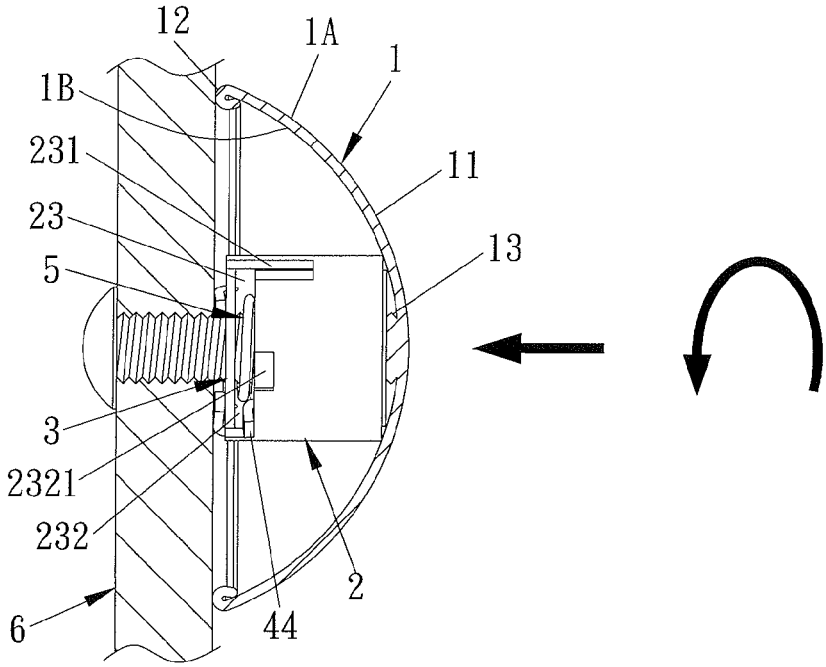
FIG. 5 is a cross sectional view showing the handle structure shifted to a safe state according to the first embodiment of the present invention.

As shown in FIG. 5, when shifting the handle structure to a safe state, the hole 31 of the cover 3 is screwed with a screw bolt, so that the handle structure is fixed on a plate 6 (such as a door plate or a drawer front), and when the body 1 is pressed to the plate 6 and is rotated, the controlling member 4 moves toward the cover 3 to further press the resilient element 5. Thereafter, the raised portion 44 of the controlling member 4 disengages from the axial section 231 of the L-shaped recess 23 and slides to the radial section 232, so that the flat rim 12 of the body 1 contacts with the plate 6, thus operating the handle structure safely.

Figure 6:
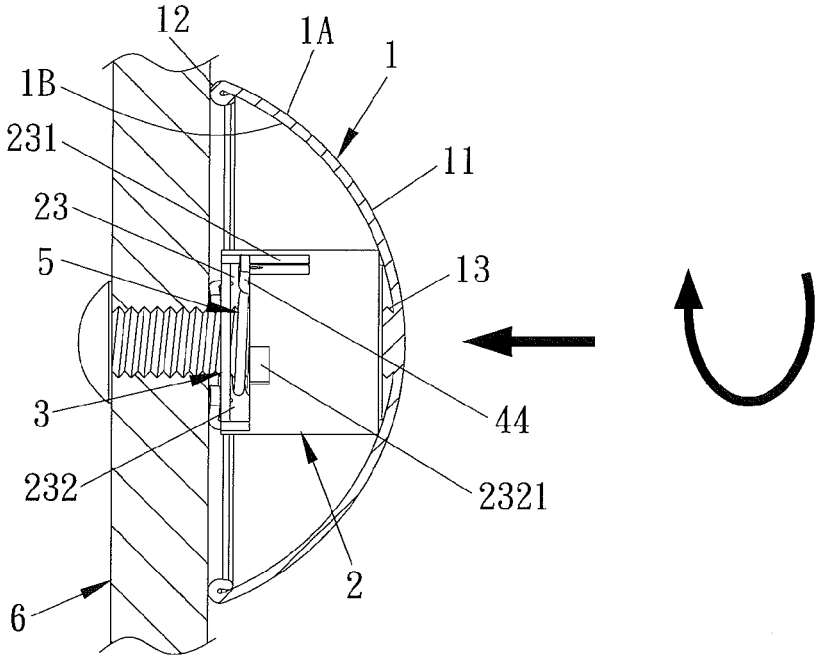
FIG. 6 is a cross sectional view showing the handle structure pressed and rotated according to the first embodiment of the present invention.
Figure 7:
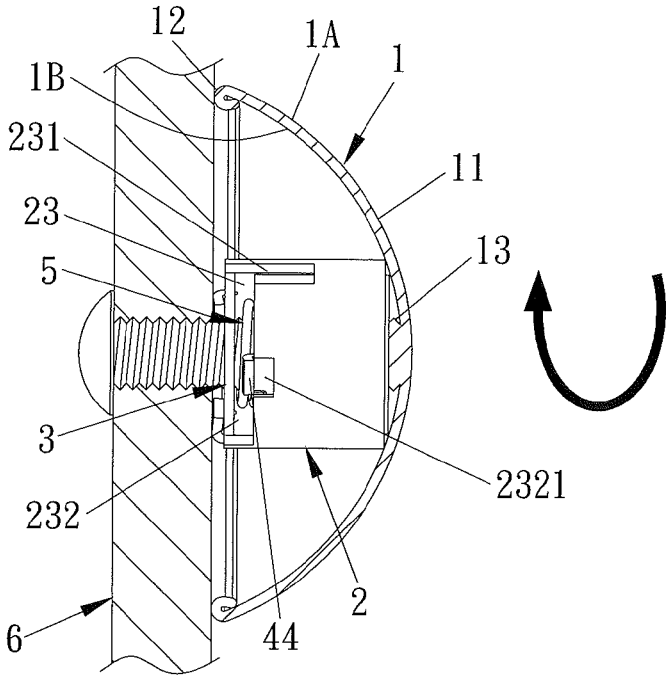
FIG. 7 is a cross sectional view showing the handle structure being rotated directly according to the first embodiment of the present invention.
Figure 8:
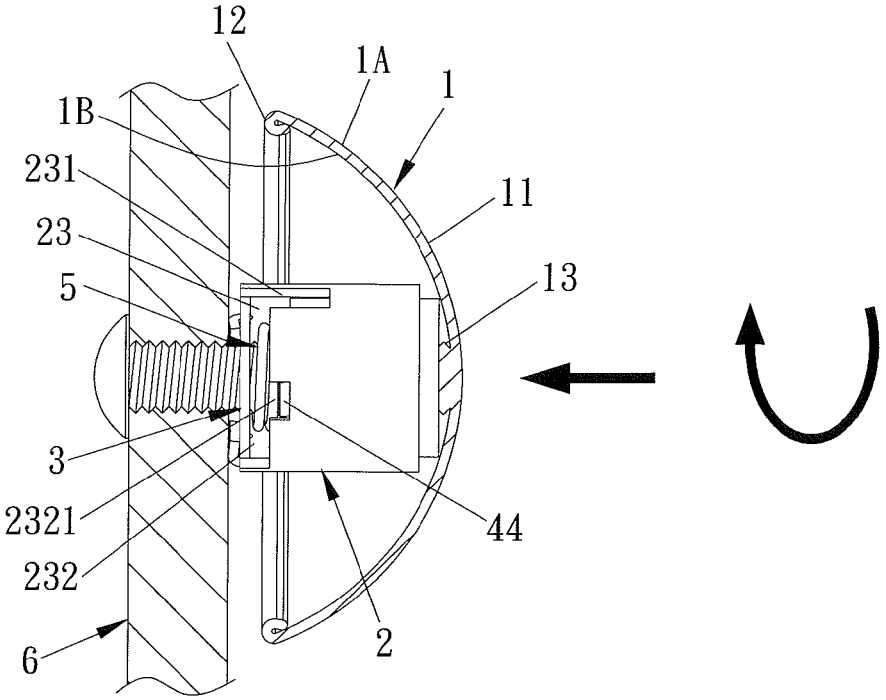
FIG. 8 is a cross sectional view showing the handle structure operated in a two-section operation mode according to the first embodiment of the present invention.
Figure 9:
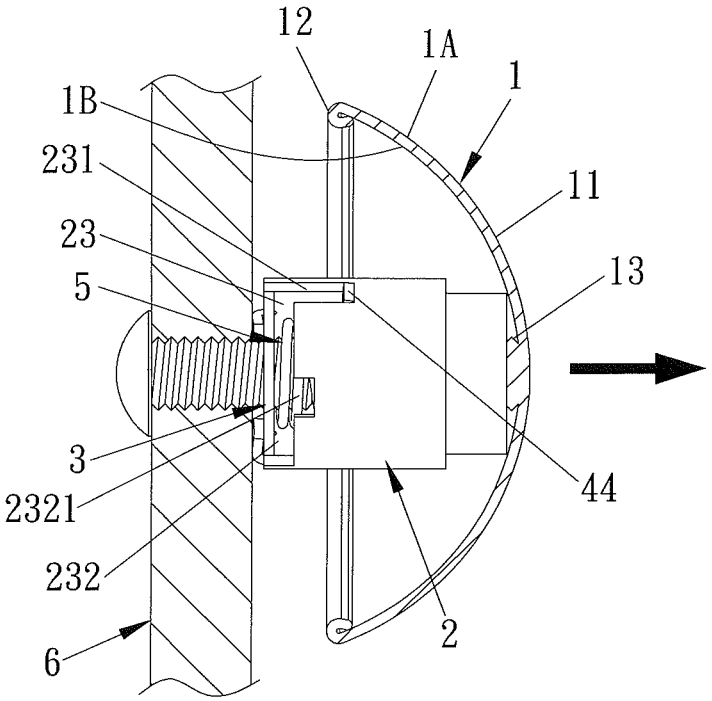
FIG. 9 is a cross sectional view showing a body of the handle structure moving forwardly according to the first embodiment of the present invention.
Figure 10:
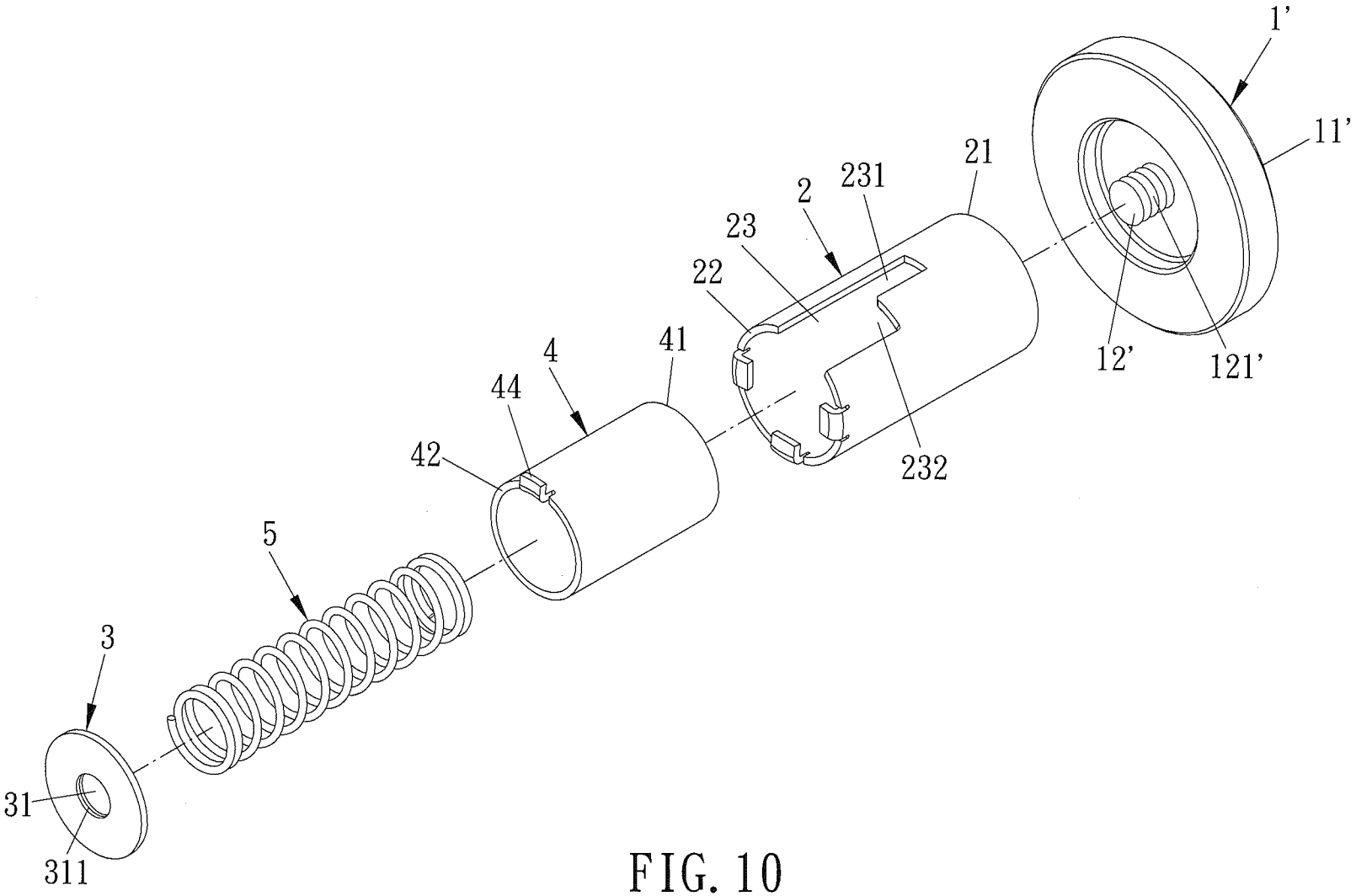
FIG. 10 is a perspective view showing the exploded components of a handle structure according to a second embodiment of the present invention.
Figure 11:
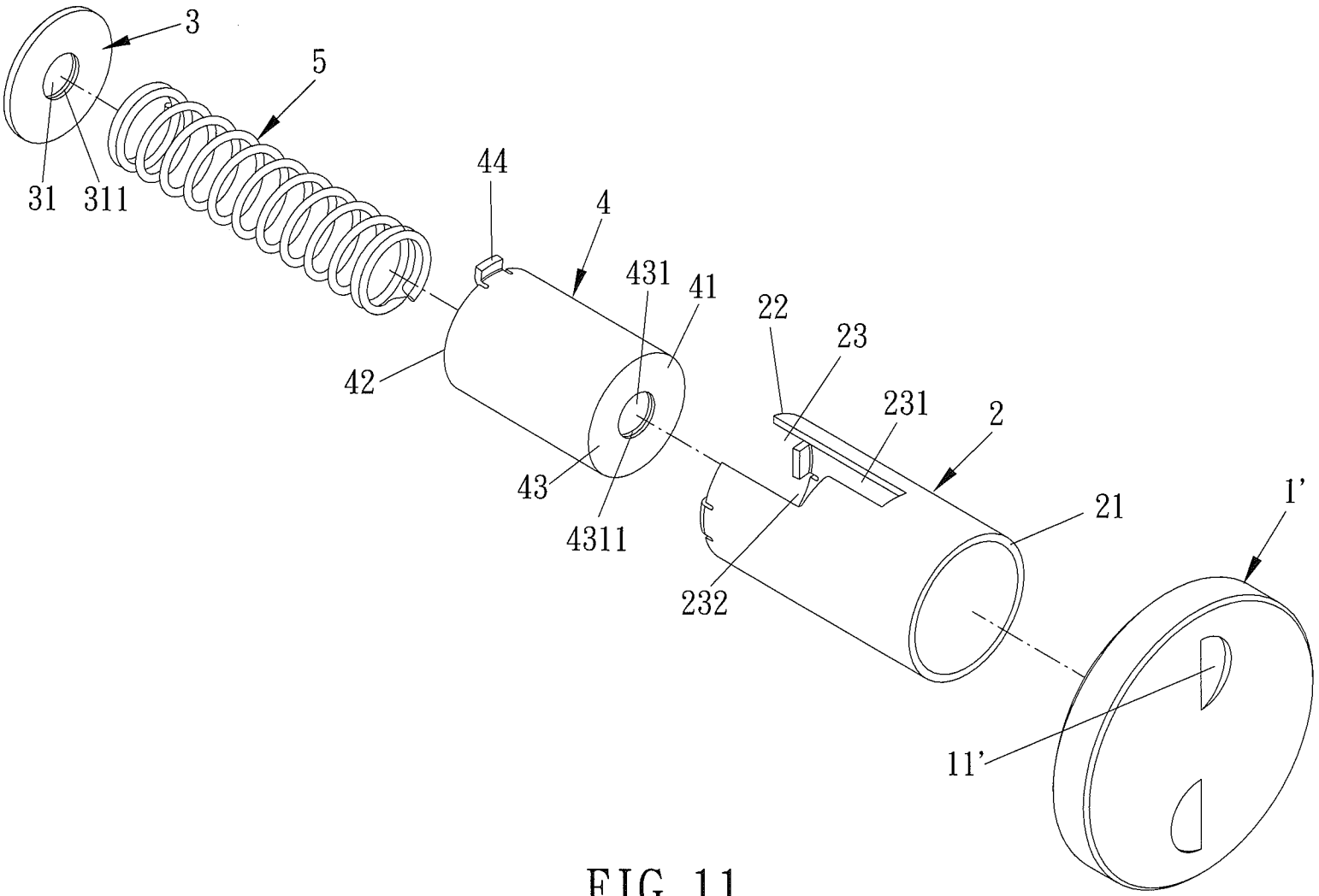
FIG. 11 is another perspective view showing the exploded components of a handle structure according to the second embodiment of the present invention.
Figure 12:
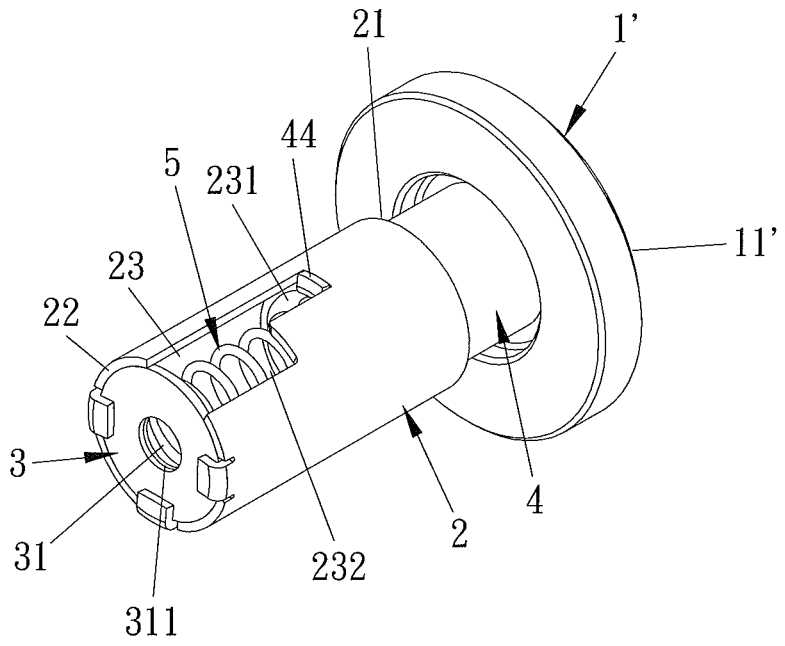
FIG. 12 is a perspective view showing the assembly of the handle structure according to the second embodiment of the present invention.
Figure 13:
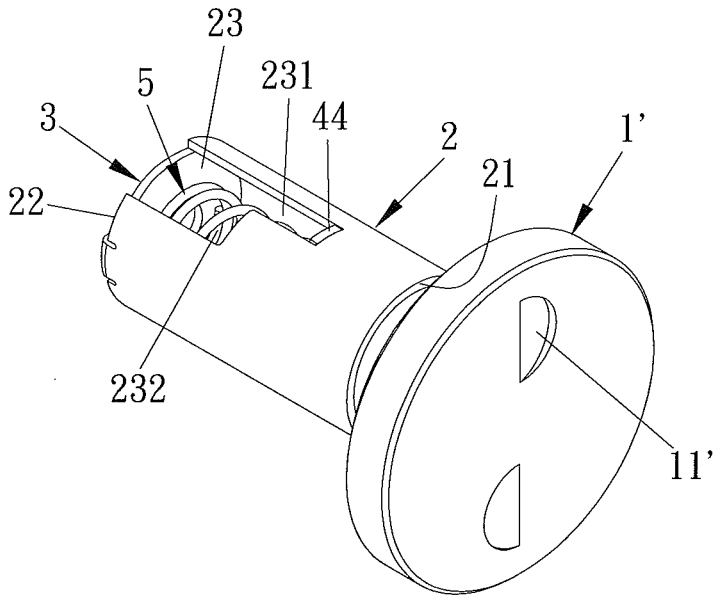
FIG. 13 is another perspective view showing the assembly of the handle structure according to the second embodiment of the present invention.
Figure 14:
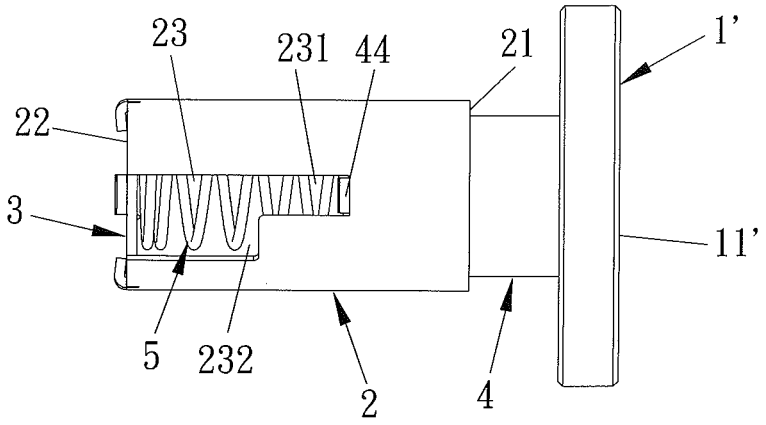
FIG. 14 is a cross sectional view showing the assembly of the handle structure according to the second embodiment of the present invention.

FIG. 6 is a cross sectional view showing the handle structure being pressed and rotated according to the first embodiment of the present invention. FIG. 7 is a cross sectional view showing the handle structure being rotated directly according to the first embodiment of the present invention. FIG. 8 is a cross sectional view showing the handle structure operated in a two-section operation mode according to the first embodiment of the present invention. FIG. 9 is a cross sectional view showing a body of the handle structure moving forwardly according to the first embodiment of the present invention. Thereby, when the body 1 presses toward the plate 6 and is rotated reversely, the raised portion 44 of the controlling member 4 slides to the radial section 232 of the L-shaped recess 23. Then, the body 1 is released so that the resilient element 5 pushes the controlling member 4 and the body 1 to move, such that the raised portion 44 of the controlling member 4 slides to the axial section 231 of the L-shaped recess 23 and is retained in a front segment of the axial section 231, thus holding the flat rim 12 of the body 1 to open a door or a drawer. Rotating the body 1 reversely, the raised portion 44 of the controlling member 4 slides to the cutout 2321 of the radial section 232 of the L-shaped recess 23. Then, the resilient element 5 pushes the controlling member 4 to move forwardly, so that the raised portion 44 of the controlling member 4 slides to and is retained with the cutout 2321 of the radial section 232 of the L-shaped recess 23. Hence, the body 1 cannot be rotated continuously, and the flat rim 12 of the body 1 cannot be held and rotated, thus preventing children from rotating the body 1. If desiring to rotate the handle structure further, the body 1 is pressed to the plate 6, so that the raised portion 44 of the controlling member 4 disengages from the cutout 2321 of the radial section 232 of the L-shaped recess 23, thus rotating the handle structure. Thereafter, the body 1 and the controlling member 4 are pushed by the resilient element 5 to move, so that the flat rim 12 of the body 1 is held by a user, thus opening the door or the drawer.

Referring further to FIGS. 10-14, a handle structure according to a second embodiment of the present invention comprises: a body 1', a housing 2, a cover 3, a controlling member 4, and a resilient element 5. The body 1' is cylindrical and includes two concaved rotating portions 11' formed on a front side thereof and a connecting column 12' fixed on a rear side thereof. The connecting column 12' has an outer screwing section 121'. The housing 2 is formed in a circular tube shape and includes a front fringe 21, a rear fringe 22, and a L-shaped recess 23 defined on an outer wall thereof. The L-shaped recess 23 has an axial section 231 and a radial section 232 adjacent to the axial section 231, and the radial section 232 has a cutout 2321 arranged thereon. The cover 3 is covered onto or integrally formed with a rear side of the housing 2 and includes a hole 31 with inner threads 311. The controlling member 4 is cylindrical and fitted into the housing 2. The controlling member 4 includes a front end 41 and a rear end 42, and the front end 41 of the controlling member 4 has a disc 43. The disc 43 has an orifice 431 defined thereon, and the orifice 431 has an inner threaded section 4311, such that the connecting column 12' of the body 1' screws with the inner threaded section 4311 of the orifice 431 via the front fringe 21. Hence, the body 1' connects with the controlling member 4. In addition, the controlling member 4 includes a raised portion 44 formed on a rear side thereof and fixed in the L-shaped recess 23 of the housing 2. The resilient element 5 is a spring mounted in the housing 2 and located between the controlling member 4 and the cover 3, such that the controlling member 4 is pushed by the resilient element 5 to move toward the body 1'.

Figure 15:
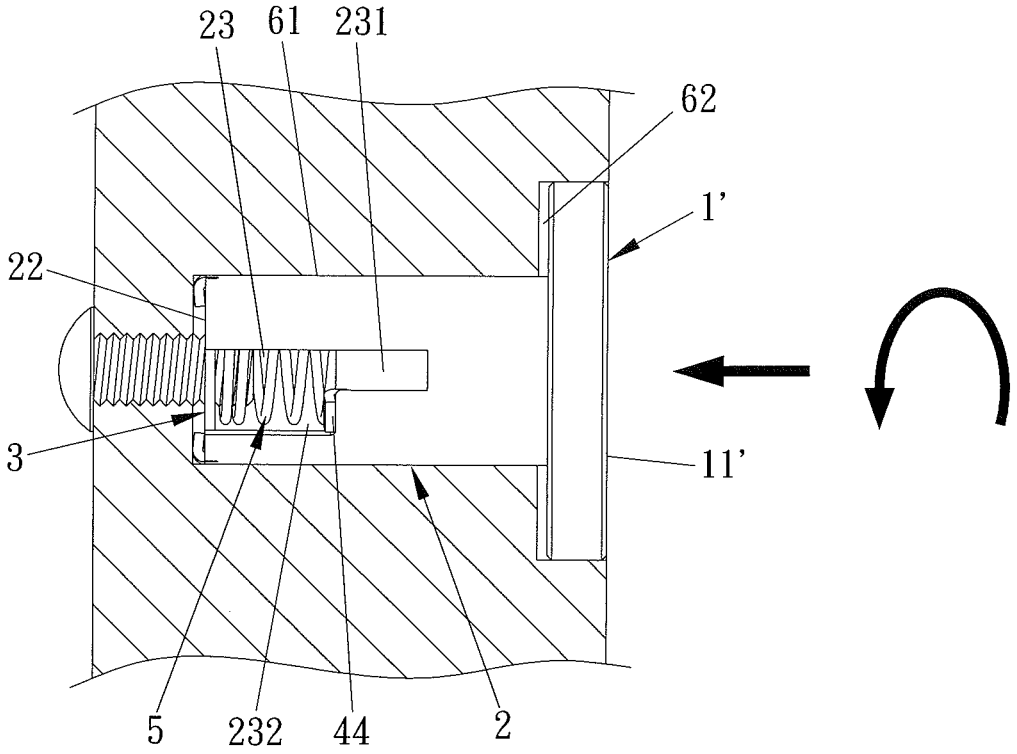
FIG. 15 is a cross sectional view showing the handle structure shifted to a safe state according to the second embodiment of the present invention.

As shown in FIG. 15, when locking the body 1' to a groove 61 of a plate 6 (such as a door plate or a drawer front), the body 1' is aligned with a slot 62 relative to the groove 61. Then, the body l' is pressed to the plate 6 and is rotated, such that the controlling member 4 moves toward the cover 3 to further press the resilient element 5. Then, the raised portion 44 of the controlling member 4 disengages from the axial section 231 of the L-shaped recess 23 and then slides to the radial section 232, so that the body 1' is retained with the slot 62 of the plate 6 and is flush with the plate 6, thus operating the handle structure safely.

Figure 16:
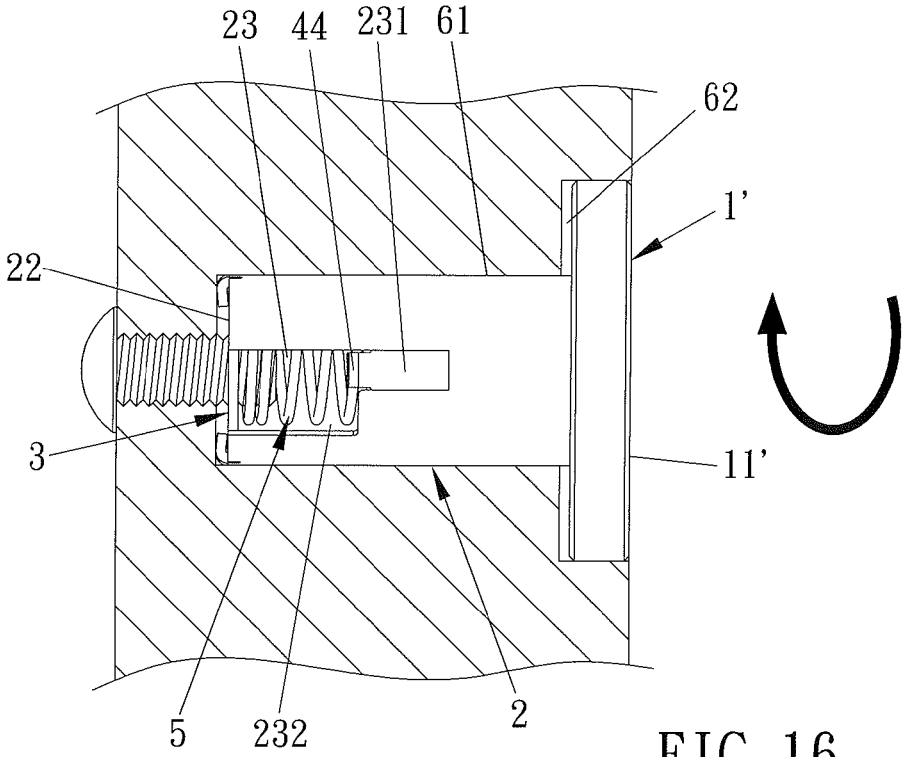
FIG. 16 is a cross sectional view showing the handle structure being rotated directly according to the second embodiment of the present invention.
Figure 17:
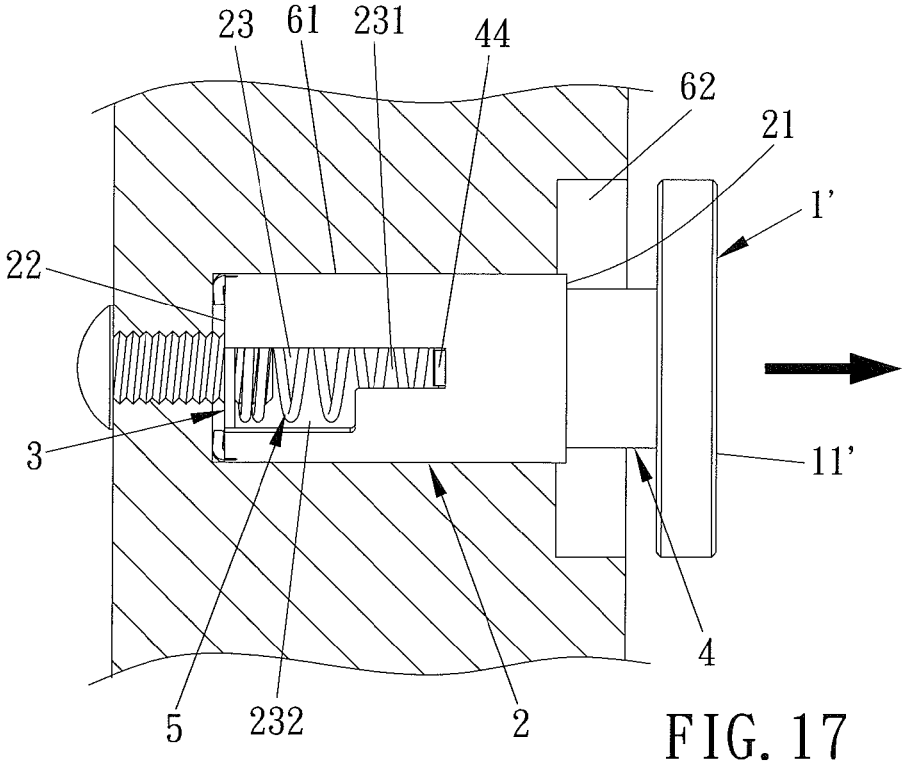
FIG. 17 is a cross sectional view showing a body of the handle structure moving forwardly according to the second embodiment of the present invention.

FIG. 16 is a cross sectional view showing the handle structure being rotated directly according to the second embodiment of the present invention. FIG. 17 is a cross sectional view showing a body of the handle structure moving forwardly according to the second embodiment of the present invention. Thereby, when the body 1' presses toward the plate 6 and is rotated reversely by ways of the two concaved rotating portions 11', the raised portion 44 of the controlling member 4 slides to the radial section 232 of the L-shaped recess 22. Then, the body 1' is released, so that the resilient element 5 pushes the controlling member 4 and the body 1' to move, such that the raised portion 44 of the controlling member 4 slides to the axial section 231 of the L-shaped recess 22, and the body 1' disengages from the slot 62 of the plate 6, thus holding the body 1' to open a door or a drawer.

Thereby, the handle structure of the present invention has the following advantages:

1. The bodies 1, 1' are contacted with or retained in the plate 6 to prevent the children from rotating the door or the drawer.

2. The bodies 1, 1' are contacted with or retained in the plate 6 to avoid interfering with people's activities or hooking an object. Also, the bodies 1, 1' are moved forward to be further opened easily.

While various embodiments in accordance with the present invention have been shown and described, it is clear to those skilled in the art that further embodiments may be made without departing from the scope of the present invention.

What is claimed is:

1. A handle structure comprising:

a body including an outer surface and an inner surface, with the outer surface having a non-grip face and a flat rim defined between the non-grip face and the inner surface, with the inner surface having a connecting column;

a housing formed in a hollow circular tube shape and including a front fringe, a rear fringe, and a L-shaped recess defined on an outer wall thereof;

a cover fixed on a rear side of the housing and used to fix the handle structure on a door plate or a drawer front;

a controlling member fitted into the housing and including a front end and a rear end, with the front end of the controlling member connecting with the connecting column of the body via the front fringe of the housing, with the controlling member also including a raised portion formed on a rear side thereof and fixed in the L-shaped recess of the housing; and a resilient element located between the controlling member and the cover, wherein the controlling member is pushed by the resilient element to move toward the body.

2. The handle structure as claimed in claim 1, wherein the connecting column of the body has outer threads, wherein the front end of the controlling member has a disc, wherein the disc has an orifice defined thereon, wherein the orifice has an inner threaded section, and wherein the connecting column of the body screws with the inner threaded section of the orifice via the front fringe.

3. The handle structure as claimed in claim 1, wherein the L-shaped recess of the housing has an axial section and a radial section adjacent to the axial section.

4. The handle structure as claimed in claim 3, wherein the radial section has a cutout arranged thereon.

5. The handle structure as claimed in claim 1, wherein the cover is covered onto or integrally formed with the rear side of the housing.

6. The handle structure as claimed in claim 1, wherein the cover includes a hole with inner threads.

7. The handle structure as claimed in claim 1, wherein the resilient element is a spring.

8. The handle structure as claimed in claim 1, wherein the non-grip face has an arcuate portion or patterns formed thereon.

9. A handle structure comprising:

a body being cylindrical and including a connecting column fixed on a rear side thereof;

a housing formed in a hollow circular tube shape and including a front fringe, a rear fringe, and a L-shaped recess defined on an outer wall thereof;

a cover fixed on a rear side of the housing and used to fix the body in a groove of a door plate or a drawer front, with the body aligned with a slot of the door plate or the drawer front relative to the groove;

a controlling member fitted into the housing and including a front end and a rear end, with the front end of the controlling member connecting with the connecting column of the body via the front fringe of the housing, with the controlling member also including a raised portion formed on a rear side thereof and fixed in the L-shaped recess of the housing; and a resilient element located between the controlling member and the cover, wherein the controlling member is pushed by the resilient element to move toward the body.

10. The handle structure as claimed in claim 9, wherein the connecting column of the body has outer threads, wherein the front end of the controlling member has a disc, wherein the disc has an orifice defined thereon, wherein the orifice has an inner threaded section, and wherein the connecting column of the body screws with the inner threaded section of the orifice via the front fringe.

11. The handle structure as claimed in claim 9, wherein the L-shaped recess of the housing has an axial section and a radial section adjacent to the axial section.

12. The handle structure as claimed in claim 9, wherein the cover is covered onto or integrally formed with the rear side of the housing.

13. The handle structure as claimed in claim 9, wherein the cover includes a hole with inner threads.

14. The handle structure as claimed in claim 9, wherein the resilient element is a spring.

15. The handle structure as claimed in claim 9, wherein the body includes two concaved rotating portions formed on a front side thereof.

* * * * *